US006051069A

United States Patent [19]

Schultz

[11] Patent Number: 6,051,069

[45] **Date of Patent: *Apr. 18, 2000**

[54] APPARATUS FOR COATING AND CURING THE BOTTOM RIM SURFACE OF A CONTAINER

[75] Inventor: Robert H. Schultz, Golden, Colo.

[73] Assignee: Coors Brewing Company, Golden, Colo.

[ * ] Notice: This patent is subject to a terminal disclaimer.

[21] Appl. No.: 09/086,961

[22] Filed: May 28, 1998

Related U.S. Application Data

[60] Division of application No. 08/680,585, Jul. 10, 1996, Pat. No. 5,786,034, which is a continuation-in-part of application No. 08/325,036, Oct. 18, 1994, Pat. No. 5,536,316.

[51] Int. Cl.[7] ..... B05C 1/00

[52] U.S. Cl. ..... 118/642; 118/58; 118/66; 118/239; 118/244; 118/258; 118/263; 118/264; 118/265; 118/DIG. 3

[58] Field of Search ..... 118/642, 58, 66, 118/239, 244, 258, 263, 264, 265, DIG. 3; 427/284, 287, 289, 290, 292, 294, 385.5, 508, 428

[56] References Cited

U.S. PATENT DOCUMENTS

| | | | |
|---|---|---|---|
| 2,334,087 | 11/1943 | Goebel et al. | 118/DIG. 3 |
| 2,335,932 | 12/1943 | Gladfelter | 118/DIG. 3 |
| 2,632,918 | 3/1953 | Bergstein | 118/DIG. 3 |
| 2,951,612 | 9/1960 | Salzenbrodt | 118/244 |
| 3,895,126 | 7/1975 | Strauss et al. | 118/66 |
| 4,136,767 | 1/1979 | Sarovich | 198/689.1 |
| 4,274,532 | 6/1981 | Johnson | 198/429 |
| 4,275,097 | 6/1981 | Shriver | 118/218 |
| 4,308,818 | 1/1982 | Abe et al. | 118/211 |
| 4,503,086 | 3/1985 | Schultz | 427/510 |
| 4,565,713 | 1/1986 | Schultz | 425/508 |
| 4,670,935 | 6/1987 | Bowler | 15/306 B |
| 4,771,879 | 9/1988 | Shriver | 198/471.1 |
| 4,773,522 | 9/1988 | Lenhart | 198/425 |
| 4,828,884 | 5/1989 | Miller | 427/284 |
| 4,942,955 | 7/1990 | Shriver et al. | 198/471.1 |
| 5,257,967 | 11/1993 | Gysin | 492/56 |
| 5,536,316 | 7/1996 | Schultz | 118/642 |

*Primary Examiner*—Laura Edwards
*Attorney, Agent, or Firm*—Klaas, Law, O'Meara & Malkin, P.C.; Joseph J. Kelly, Esq.; William P. O'Meara, Esq.

[57] ABSTRACT

Apparatus for coating the bottom rim surface of a container using a vacuum conveyor for holding and transporting a plurality of empty containers with the bottom rim surfaces exposed so that the bottom rim surfaces may be passed over a coating applicator roll and through a curing oven to provide the bottom rim surfaces with a cured coating and wherein the vacuum conveyor is wide enough so that a plurality of the bottom rim surfaces may be coated at the same time and then passed through the curing oven. Also, the durometer of the application roll can be varied so as to apply a coating of uniform thickness or a coating of varying thicknesses.

9 Claims, 2 Drawing Sheets

APPARATUS FOR COATING AND CURING THE BOTTOM RIM SURFACE OF A CONTAINER

This application is a divisional application of U.S. patent application Ser. No. 08/680,585, filed Jul. 10, 1996, now U.S. Pat. No. 5,786,034 issued Jul. 28, 1998 for Apparatus For Coating and Curing The Bottom Rim Surface Of A Container of Robert H. Schultz, which is a continuation-in-part of U.S. patent application Ser. No. 08/325,036 filed Oct. 18, 1994, now U.S. Pat. No. 5,536,316, issued Jul. 16, 1996, for Apparatus For Coating And Curing The Bottom Rim Surface Of A Container of Robert H. Schultz.

FIELD OF THE INVENTION

This invention is directed generally to the manufacture of containers and more particularly to providing the bottom rim surface of each container with a cured coating.

BACKGROUND OF THE INVENTION

In the manufacture of container body portions, it is sometimes desirable to provide the bottom rim surface of a container with a cured coating. In one type of apparatus for providing such a cured coating, a plurality of containers are supported on a vacuum conveyor with their exposed bottom surfaces located above the vacuum conveyor. The plurality of containers are in single file. The plurality of containers pass underneath a coating applying apparatus and then through a convection oven. While this apparatus does provide the bottom rim surfaces with a cured coating, it is slow and somewhat sloppy. In another type of apparatus, a plurality of containers are located in single file on a pin conveyor and are passed through a coating applying apparatus to apply a coating material to the bottom rim surfaces and then passed through a curing oven. If the coating material is an UV photo reactive coating material, the curing oven has a plurality of irradiator means for producing UV radiation to cure the UV photo reactive coating material.

BRIEF DESCRIPTION OF THE INVENTION

This invention provides apparatus for providing the bottom rim surface of a container with a cured coating wherein a plurality of containers are conveyed over a coating applicator roll having a layer of coating material thereon with their bottom rim surfaces facing downwardly to transfer a portion of the layer of coating material to the bottom rim surfaces and then passed through a curing oven to cure the coating material thereon.

In a preferred embodiment of the invention, the apparatus for providing the bottom rim surface of a container with a cured coating comprises a first conveyor for transporting a plurality of empty containers with the open ends thereof exposed and the bottom rim surfaces thereof in contact with the first conveyor which has an end portion and a second conveyor for transporting the plurality of empty containers from a first location to a second location. The first location comprises an end portion of the second conveyor superposed over the end portion of the first conveyor. Transfer means are provided for transferring the plurality of empty containers from the end portion of the first conveyor to the end portion of the second conveyor with the open ends in contact with the second conveyor and the bottom rim surfaces exposed. Coating means are provided for providing a coating material on the bottom rim surface of each of the plurality of empty containers. A curing means is provided and the second conveyor passes through the curing means to cure the coating material on the bottom rim surface of each of the plurality of empty containers. Collecting means are provided for collecting the plurality of cured bottom rim coated containers.

The coating means comprise a tank having a supply of coating material contained therein. An applicator roll having an outer peripheral surface is mounted on the tank for rotation relative thereto. Coating applying means are located in the tank for applying a layer of a desired amount of coating material on the outer peripheral surface. The applicator roll is located so that the coating material on the outer peripheral surface moves into contact with the bottom rim surface of each of the plurality of empty containers to apply the coating material thereto. First driving means are provided for moving the second conveyor in a predetermined direction and at a predetermined speed. Second driving means are provided for rotating the applicator roll so that the outer peripheral surface is moving in the same direction and at the same speed as the second conveyor when it contacts the bottom surface of each of the plurality of empty containers. The first and second driving means are drawn by the same motor. The outer surface is formed from an elastomeric material.

The transfer means comprise a vacuum source. The second conveyor passes over the vacuum source to pull each of the plurality of empty containers off of the end portion of the first conveyor and the open end into contact with the end portion of the second conveyor. The vacuum source functions to hold each of the plurality of empty containers in contact with the second conveyor as the second conveyor passes through the curing means. When the coating material comprises a UV photo reactive material, the curing means comprise a housing and a plurality of irradiator means located in the housing for producing UV radiation to cure the UV photo reactive coating.

In a preferred embodiment of the invention, each of the first and second conveyors has a width at least equal to the combined diameters of at least three of the plurality of empty containers so that the applicator roll applies the coating material to the bottom rim surfaces of a plurality of the plurality of empty containers at the same time. The outer peripheral surface has a width at least substantially equal to the width of the second conveyor. The applicator roll is located so that the coating material on the outer peripheral surface moves into contact with the bottom rim surfaces of a plurality of the plurality of empty containers at the same time. The collecting means comprise a third conveyor for transporting the plurality of bottom rim surface coated empty containers with their open end exposed and the cured coated bottom end surfaces in contact with the third conveyor which have an end portion. The second location comprises another end portion of the second conveyor superposed over the end portion of the third conveyor. Another transfer means comprising a vacuum cut off means is provided for transferring the plurality of cured bottom rim surface coated empty containers from the another end portion to the end portion of the third conveyor. The third conveyor has a width substantially the same as the width of the first conveyor.

The second conveyor and the application roll are located relative to each other so that when the bottom rim surface contacts the coating material on the applicator roll, a pressure is applied to the applicator roll so that the outer surface of the outer portion of the applicator roll is deformed slightly in the amount of about 0.030 inch. When the outer portion of the applicator roll comprises an elastomeric material having a Shore A durometer of between 35 and 45 and preferably of about 40, the coating material on the central portion of the bottom rim surface and the adjacent radially inward and outward integral portions thereof will have varying thicknesses. When the outer portion of the applicator roll comprises a closed cell foamed elastic material having a Shore A durometer of between about 15 and 25 and preferably of about 20, the coating material on the central portion of the bottom rim surface and the adjacent radially inward and outward integral portions thereof will have substantially the same thickness.

BRIEF DESCRIPTION OF THE DRAWING

An illustrative and presently preferred embodiment of the invention is illustrated in the drawing in which.

DETAILED DESCRIPTION OF THE INVENTION

Figure 2:
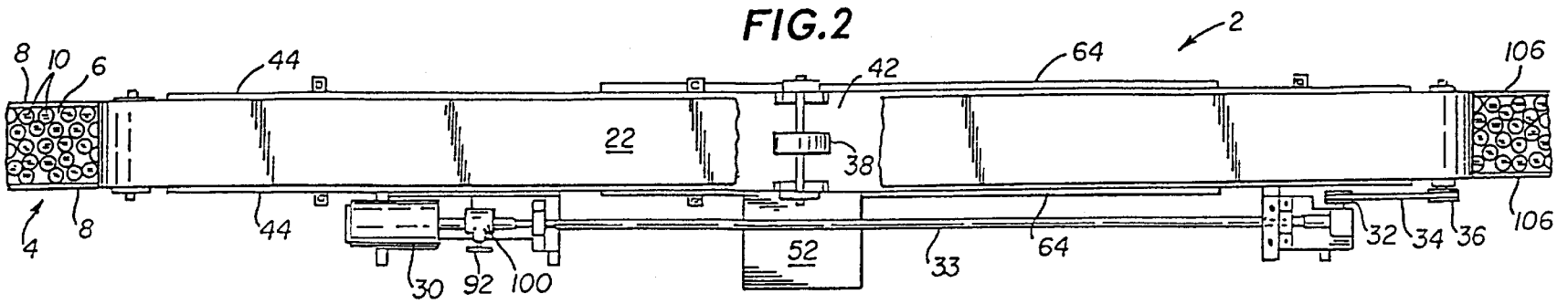
FIG. 2 is a top plan view of FIG. 1.
Figure 1:
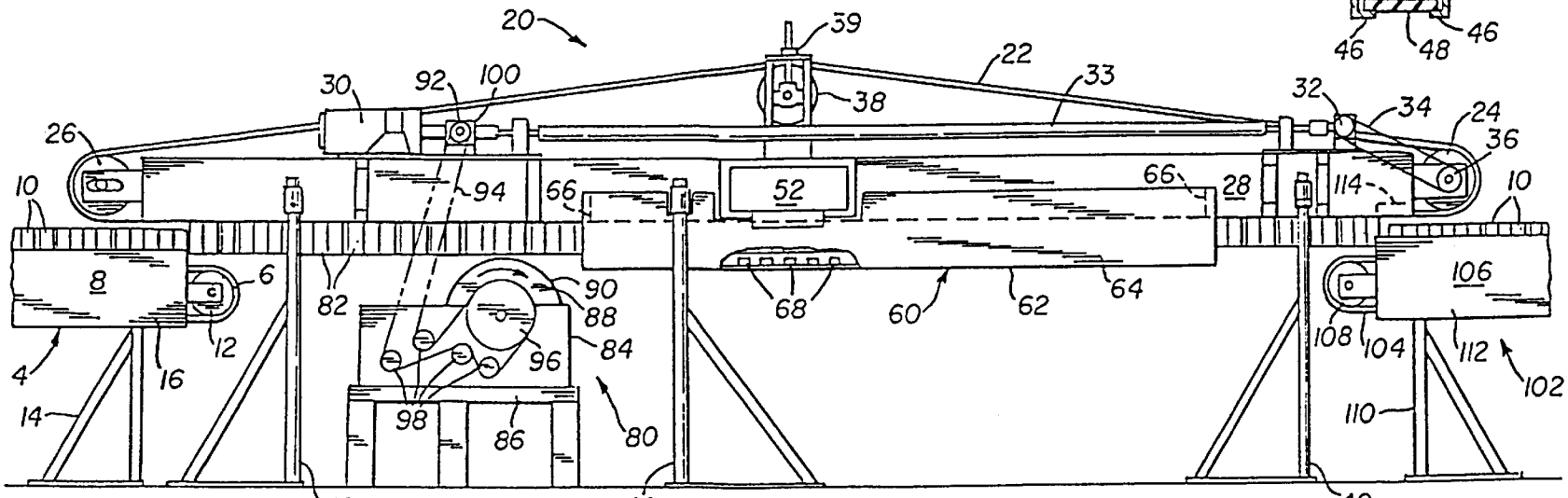
FIG. 1 is a side elevational view of an apparatus of this invention.

The apparatus 2 of this invention is illustrated in FIGS. 1 and 2. A first conveyor 4 has a conveyor belt 6 located between two opposite sidewalls 8. A plurality of empty containers 10 are carried by the conveyor belt 6 with the open ends of the containers 10 facing up. As illustrated in FIG. 2, the conveyor belt 6 is wide enough so that a plurality of containers 10 are located between the sidewalls 8. The conveyor belt 6 is trained around an idler roll 12. A drive roll, not shown, is located at the other end of the conveyor 4. The first conveyor 4 is mounted on fixed supports 14, only one of which is shown. The first conveyor 4 has an end portion 16 for a purpose described below.

Figure 3:
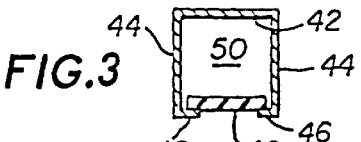
FIG. 3 is a view in cross-section of the vacuum chamber.

A second conveyor 20 has a fluid pervious conveyor belt 22 having a width that is the same as or slightly larger than the width of the conveyor belt 6. The conveyor belt 22 is journaled between a drive roll 24 and an idler roll 26, each of which is mounted on a housing 28. A motor 30 is mounted on the housing 28 and rotates a pulley 32 using conventional apparatus 33. A drive chain 34 is journaled around the pulley 32 and a pulley 36 that is connected to the drive roll 24 so that rotation of the pulley 36 rotates the drive roll 24. An idler roll 38 is adjustably mounted on the housing 28 by adjusting means 39 to adjust the tension in the conveyor belt 22. The housing 28 is mounted on a plurality of fixed supports 40. The housing 28 is illustrated in FIG. 3 and has a top wall 42, opposite sidewalls 44 and opposite flange portions 46 on which the lower reach 48 of the conveyor belt 22 slides. A vacuum is formed in the vacuum chamber 50 by a blower 52 mounted on the housing 28. If desired, wear strips formed from a suitable plastic material may be attached to the flange portions 46.

A curing oven 60 has a bottom wall 62, opposite sidewalls 64 and opposite end walls 66 that terminate at a location above the lower reach 48. The sidewalls 64 are secured to the sidewalls 44 by suitable means, such as bolts and nuts (not shown). A plurality of irradiator means 68 for producing UV radiation are mounted on the bottom wall 62.

In FIG. 1, there is located coating apparatus 80 for applying a coating material to the bottom rim surface 82 of each container 10. The coating apparatus 80 comprises a tank 84 for holding a supply of coating material (not shown) and which tank is mounted on a fixed support 86. The coating material preferably is a UV photo reactive coating material. A rubber applicator roll 88 is mounted for rotation in the tank 84 and conventional metering means (not shown) are provided to apply a desired amount of coating material to the outer surface 90 of the rubber applicator roll 88. The outer surface 90 has a width equal to or slightly greater than the width of the second conveyor belt 22. The rubber applicator roll 88 is rotated by drive means comprising a pulley 92 rotated by the motor 30 and a drive belt 94 journaled around pulley 96 connected to the rubber applicator roll 88 and tensioning pulleys 98. Therefore, rotation of the pulley 82 rotates the pulley 96 to rotate the rubber applicator roll 88. Control means 100 are provided to rotate the applicator roll 88 so that the outer surface 90 is moving at the same rate of speed and in the same direction as the lower reach 48 of the conveyor belt 22.

Collecting means are provided for collecting the containers 10 having a cured coating on the bottom rim surfaces 82 and comprise a third conveyor 102 having a conveyor belt 104 located between opposite sidewalls 106. The conveyor belt 104 has a width the same as or slightly less than the conveyor belt 22. The conveyor belt 104 is trained around an idler roll 108. A drive roll (not shown) is mounted at the other end of the conveyor belt 104. The third conveyor 102 is mounted on fixed supports 110, only one of which is shown. The third conveyor has an end portion 112 for a purpose described below. Vacuum cut-off means 114 are mounted on the sidewalls 44.

Figure 4:
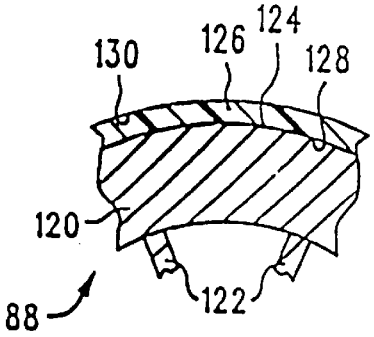
FIG. 4 is a cross-sectional view of a portion of an applicator roll.

In operation, a plurality of empty containers 10 are fed onto the conveyor belt 6 so that several containers 10 are located between the sidewalls 8 with their open ends facing up. As the containers 10 reach the end portion 16, they are subjected to the vacuum in the vacuum chamber 50 and are transferred from the conveyor belt 6 to the lower reach 48 of the conveyor belt 22 which is formed from a fluid pervious material. The open ends of the containers 10 are in contact with the lower reach 48. The containers 10 move with the lower reach 48 and the bottom rim surfaces 82 move into contact with the outer surface 90 so that a layer of coating material is applied to the bottom rim surfaces. The lower reach 48 and the outer peripheral surface 90 are moving at the same speed and in the same direction when the coating material is being applied. The coating material preferably is an UV photo reactive coating material. The coated containers 10 move with the lower reach 48 into the curing oven 60 where they are subjected to the UV radiation produced by the irradiator means 68 to cure the UV photo reactive coating on the bottom rim surfaces 82. The containers 10 with the cured coated bottom rim surfaces 82 move with the bottom reach 48 out of the curing oven 60 until they reach the location that is superposed over the end portion 112. The vacuum cut-off means 114 cuts off the vacuum so that the containers 10 with the cured coated bottom rim surfaces 82 are transferred from the lower reach 48 onto the conveyor belt 104 to move with the conveyor belt 104 for further processing. The construction of the application roll 88 is illustrated in FIG. 4 and comprises a rigid core 120 formed from a suitable metallic or plastic material, connected by a plurality of spokes 122 to a shaft (not shown) and having a generally cylindrical outer surface 124. An outer hollow cylindrical covering 126 has a generally cylindrical inner surface 128 secured to the generally cylindrical outer surface 124 and a generally cylindrical outer surface 130 adapted to be coated by a coating material as described above. In one preferred embodiment of the invention, FIG. 5, the outer hollow cylindrical covering 126 is formed from an elastomeric material 131, such as a polyurethane or an ethylene propylene di-monomer or other materials having similar characteristics, having a Shore A durometer of between about 35 and 45 and preferably 40. In another preferred embodiment of the invention, FIG. 6, the outer hollow cylindrical covering 126 is formed from a closed cell foamed elastomeric material 132, such as ethylene propylene di-monomer or other materials having similar characteristics, having a Shore A durometer of between about 15 and 25 and preferably of about 20. The closed cell foamed elastomeric material 132 has plurality of surface indentations 134. An opened cell foamed elastomeric material can also be used.

Figure 5:
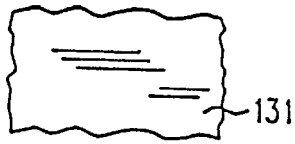
FIG. 5 is a plan view of a portion of the outer surface of one preferred embodiment of a applicator roll of this invention.
Figure 7:
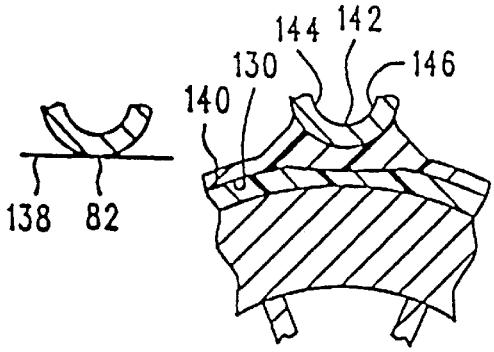
FIG. 7 is a cross-sectional view illustrating the application of coating material by the embodiment of FIG. 5.
Figure 8:
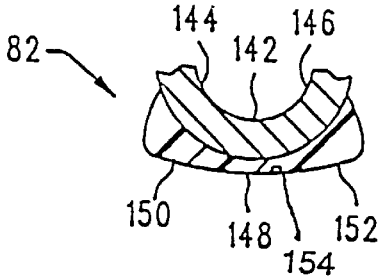
FIG. 8 is a cross-sectional view of the coating material applied in FIG. 7.

The operation of an applicator roll 88 of FIGS. 4 and 5 is illustrated in FIGS. 7 and 8. The second conveyor 20 holds the empty containers 10 so that the bottom rim surface 82 of each empty container 10 is located in a plane 138 that is substantially tangent to the outer surface 130 of the outer hollow cylindrical covering 126. A layer 140 of coating material has been applied to the outer surface 130 as described above. As the bottom rim surface 82 moves into contact with the layer 140 of coating material, it applies pressure to the layer 140 of coating material and deforms the outer surface 130 slightly, generally about 0.030 inch. Portions of the coating material adhere to the central portion 142 of the bottom rim surface 82, the adjacent integral radially outward portion 144 and the adjacent radially inward portion 146 of the bottom rim surface 82. As illustrated in FIG. 8, the coating material 148 at the central portion 142 of the bottom rim surface 82 is thinner than the coating material 150 on the portion 144 and the coating material 152 on the portion 146.

Figure 6:
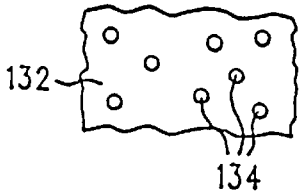
FIG. 6 is a plan view of a portion of the outer surface of another preferred embodiment of an applicator roll of this invention.
Figure 9:
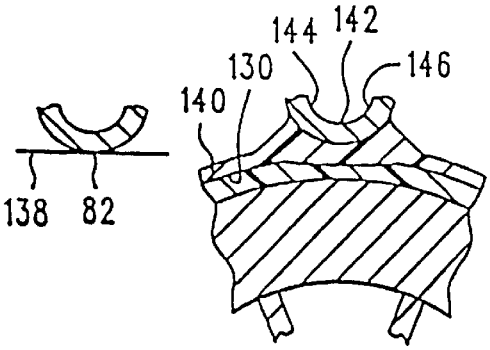
FIG. 9 is a cross-sectional view illustrating the application of coating material by the embodiment of FIG. 6.
Figure 10:
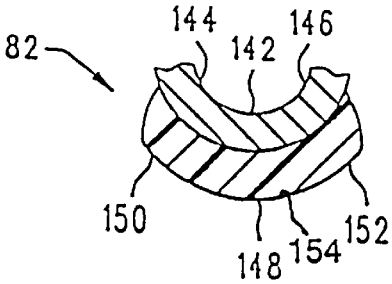
FIG. 10 is a cross-sectional view of the coating material applied in FIG. 9.

The operation of an applicator roll 88 of FIGS. 4 and 6 is illustrated in FIGS. 9 and 10. Once again, the second conveyor 20 holds the empty containers 10 so that the bottom rim surface 82 of each empty container 10 is located in a plane 138 that is substantially tangent to the outer surface 130 of the outer hollow cylindrical covering 126. A layer 140 of coating material has been applied to the outer surface 130 as described above. As the bottom rim surface 82 moves into contact with the layer 140 of coating material, it applies pressure to the layer 140 of coating material and deforms the outer surface 130 slightly, generally about the same 0.030 inch. Portions of the coating material adhere to the central portion 142 of the bottom rim surface 82, the adjacent integral radially outward portion 144 of the bottom rim surface 82 and the adjacent integral radially inward portion 146 of the bottom rim surface 82. As illustrated in FIG. 10, the coating material 154 on the central portion 142, the portion 144 and the portion 146 is substantially of uniform thickness. It is believed that this is due to the difference in the Shore A durometer between the elastomeric materials 131 and 132 and the presence of the indentations 134. The outer surface of the coating material 154 is slightly uneven.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. Apparatus for providing a bottom rim surface of a container with a cured coating comprising:

a conveyor for transporting a plurality of empty containers, each having an open end, a sidewall, and a bottom rim surface, with said open ends thereof in contact with said conveyor and said bottom rim surfaces exposed;

coating apparatus for providing a coating material on said bottom rim surface of each of said plurality of empty containers;

curing means located so that said conveyor may pass therethrough;

said conveyor passing through said curing means to cure said coating material on said bottom rim surface of each of said plurality empty containers;

collecting means for collecting said plurality of empty containers having cured coated bottom rim surfaces;

said coating apparatus comprising;

a tank having a supply of coating material contained therein;

an applicator roll mounted on said tank for rotation relative thereto;

said applicator roll having an outer surface;

coating applying means in said tank for applying a desired amount of said coating material on said outer surface; and said applicator roll being located so that said coating material on said outer surface moves into contact with said bottom rim surface of each of said plurality of empty containers to apply said coating material thereto.

2. Apparatus as in claim 1 and further comprising:

said bottom rim surface having a central portion, an adjacent integral radially outward portion and an adjacent integral radially inward portion;

said radially outward and inward portions being inclined in an axial direction relative to said central portion and extending generally in an axial direction toward said open end; and said plurality of empty containers being located on said conveyor so that said central portion and said radially outward portions penetrate into said coating material on said outer surface so that said coating material is applied to said central portion and said radially outward and inward portions.

3. Apparatus as in claim 1 wherein said applicator roll comprises:

a rigid core having an outer cylindrical surface; and an outer hollow cylindrical covering formed from a resilient material secured to said outer cylindrical surface.

4. Apparatus as in claim 3 and further comprising:

said bottom rim surface having a central portion, an adjacent integral radially outward portion and an adjacent integral radially inward portion;

said radially outward and inward portions being inclined in an axial direction relative to said central portion and extending generally in a direction toward said open end; and said plurality of empty containers being located on said conveyor so that said central portion and said radially outward and inward portions deform a portion of said resilient material so that said coating material is applied to said central portion and said radially outward and inward portions.

5. Apparatus as in claim 4 wherein said resilient material comprises:

a foamed elastomeric material having a Shore A durometer between about 15 and 25.

6. Apparatus as in claim 4 wherein:

said foamed elastomeric material has a Shore A durometer of about 20.

7. Apparatus as in claim 4 wherein said resilient material comprises:

an elastomeric material having a Shore A durometer of between about 35 and 45.

8. Apparatus as in claim 4 wherein said resilient material comprises:

an elastomeric material having a Shore A durometer of about 40.

9. Apparatus as in claim 4 and further comprising:

said plurality of empty containers on said conveyor being located so that said central portions lie in a plane tangent to said hollow cylindrical covering.

* * * * *